US008610648B2

(12) United States Patent
Goh et al.

(10) Patent No.: US 8,610,648 B2
(45) Date of Patent: Dec. 17, 2013

(54) DISPLAY DEVICE COMPRISING THRESHOLD VOLTAGE COMPENSATION FOR DRIVING LIGHT EMITTING DIODES AND DRIVING METHOD OF THE SAME

(75) Inventors: Joon-Chul Goh, Seoul (KR); Young-Soo Yoon, Suwon-si (KR); Chong-Chul Chai, Seoul (KR)

(73) Assignee: Samsung Display Co., Ltd. (KR)

( * ) Notice: Subject to any disclaimer, the term of this patent is extended or adjusted under 35 U.S.C. 154(b) by 1013 days.

(21) Appl. No.: 12/241,641

(22) Filed: Sep. 30, 2008

(65) Prior Publication Data

US 2009/0167743 A1 Jul. 2, 2009

(30) Foreign Application Priority Data

Dec. 26, 2007 (KR) ..... 10-2007-0137769

(51) Int. Cl.
*G09G 3/30* (2006.01)
*G09G 3/32* (2006.01)

(52) U.S. Cl.
USPC ..... 345/78; 345/82

(58) Field of Classification Search
USPC ..... 345/78, 211, 82
See application file for complete search history.

(56) References Cited

U.S. PATENT DOCUMENTS 7,102,202 B2 * 9/2006 Kobayashi et al. ..... 257/401
2005/0140605 A1 * 6/2005 Jung ..... 345/76
2005/0280614 A1 * 12/2005 Goh ..... 345/76
2006/0103322 A1 * 5/2006 Chung et al. ..... 315/169.3
2006/0158394 A1 * 7/2006 Choi ..... 345/76

FOREIGN PATENT DOCUMENTS

| | | | |
|---|---|---|---|
| CN | 1657263 | A | 8/2005 |
| CN | 1658263 | A | 8/2005 |
| CN | 1713253 | A | 12/2005 |
| CN | 1776794 | A | 5/2006 |
| CN | 1794331 | A | 6/2006 |
| JP | 3892732 | B2 | 12/2006 |

* cited by examiner

*Primary Examiner* — Chanh Nguyen
*Assistant Examiner* — John Kirkpatrick
(74) *Attorney, Agent, or Firm* — Cantor Colburn LLP

(57) ABSTRACT

A display device having a plurality of pixels, each pixel includes a light-emitting element, a storage capacitor, a driving transistor, a first switching transistor which supplies a data voltage to the storage capacitor in response to an on-voltage of a scanning signal, a second switching transistor which diode-connects the driving transistor in response to an on-voltage of a compensation signal, and a third switching transistor which supplies a driving voltage to the driving transistor in response to an on-voltage of a light emitting signal. The storage capacitor stores a control voltage depending on a threshold voltage of the driving transistor when the driving transistor is diode-connected, transmits the control voltage and the data voltage to the control terminal of the driving transistor, and a period in which the compensation signal is in an on-voltage state is longer than a period in which the scanning signal is in an on-voltage state.

8 Claims, 9 Drawing Sheets

DISPLAY DEVICE COMPRISING THRESHOLD VOLTAGE COMPENSATION FOR DRIVING LIGHT EMITTING DIODES AND DRIVING METHOD OF THE SAME

This application claims priority to Korean Patent Application No. 10-2007-0137769 filed on Dec. 26, 2007, and all of the benefits accruing therefrom under 35 U.S.C. §119, and the contents of which in its entirety is herein incorporated by reference.

BACKGROUND OF THE INVENTION

1. Field of the Invention

The present invention relates to a display device and a driving method of the same.

2. Description of the Related Art

A conventional display device includes a plurality of pixels arranged in a matrix form, and an image is displayed by controlling light strength of each pixel according to given luminance information. An organic light emitting display is a display device which displays an image by electrically exciting a fluorescent organic material and allowing the fluorescent organic material to emit light. The organic light emitting display is a self-emitting display device, and includes low power consumption, a wide viewing angle, and a fast pixel response speed, thereby easily displaying a high quality motion picture.

The organic light emitting display includes an organic light emitting diode ("OLED") and a thin film transistor ("TFT") which drives the OLED. The TFT is classified as a polysilicon TFT and an amorphous silicon TFT according to the type of active layer.

When an active layer of the TFT is formed, a deviation is generated in a threshold voltage of TFTs in one panel due to a non-uniform process. Further, as the TFT continuously supplies a current to the OLED, the threshold voltage of the TFT may be changed. When a deviation is generated in the threshold voltage of the TFTs or when the threshold voltage is changed, the TFTs flow a different current in response to an identical data voltage, whereby brightness uniformity of a screen is deteriorated.

In order to remove the influence due to a deviation in a threshold voltage of the TFT, a conventional method exists which allows a driving current which flows by the TFT not dependent on the threshold voltage by storing the threshold voltage in a capacitor. The conventional method includes storing a threshold voltage in a capacitor according to a scanning signal of a previous scanning line before storing a data voltage in a capacitor according to a scanning signal of a current scanning line. Thus, a capacitor is charged or discharged until a voltage between a gate and a source becomes a threshold voltage by flowing a current to the TFT.

In the conventional method, a compensation time in which a threshold voltage is stored in the capacitor corresponds to a period of the scanning signal of the previous scanning line and is equal to or less than one horizontal period. However, if a voltage between a gate and a source approaches a threshold voltage, because a current flowing to the TFT rapidly decreases, a charge or discharge speed of the capacitor becomes slow. Accordingly, since the capacitor cannot be fully charged or discharged in a compensation time period, a threshold voltage may not be stored in the capacitor and thus, brightness uniformity of a screen due to a deviation of a threshold voltage may still be deteriorated.

BRIEF SUMMARY OF THE INVENTION

The present invention has been made in an effort to solve the above-stated problems and aspects of the present invention provide a display device and a driving method of the same having advantages of fully compensating a threshold voltage of a TFT.

In an exemplary embodiment, the present invention provides a display device including a plurality of pixels each including a light-emitting element, a storage capacitor, a driving transistor, and first, second and third switching transistors. The driving transistor includes a control terminal, an input terminal, and an output terminal, and supplies a driving current to the light-emitting element to emit light, and the first switching transistor supplies a data voltage to the storage capacitor in response to an on-voltage of a scanning signal. The second switching transistor diode-connects the driving transistor in response to an on-voltage of a compensation signal, and the third switching transistor supplies a driving voltage to the driving transistor in response to an on-voltage of a light emitting signal. The storage capacitor stores a control voltage depending on a threshold voltage of the driving transistor when the driving transistor is diode-connected. The storage capacitor transmits the control voltage and the data voltage to the control terminal of the driving transistor, and a period in which the compensation signal is in an on-voltage state is longer than a period in which the scanning signal is in an on-voltage state.

According to an exemplary embodiment, the control voltage depends on a threshold voltage of the light-emitting element in addition to a threshold voltage of the driving transistor.

According to an exemplary embodiment, the display device further includes a first light emitting signal line which transfers the light emitting signal to a first pixel of the plurality of pixels, a first compensation signal line which transfers the compensation signal to the first pixel, a second light emitting signal line which transfers the light emitting signal to a second pixel of the plurality of pixels, a second compensation signal line which transfers the compensation signal to the second pixel, and a light emitting driver which generates the light emitting signal to sequentially apply the light emitting signal to the first and second light emitting signal lines and which generates the compensation signal and sequentially applies the compensation signal to the first and second compensation signal lines.

According to an exemplary embodiment, the light emitting driver generates the compensation signal which is transferred to the second compensation signal line by inverting the light emitting signal which is transferred to the first light emitting signal line. According to another exemplary embodiment, the light emitting driver generates the light emitting signal which is transferred to the first light emitting signal line by inverting the compensation signal which is transferred to the second compensation signal line.

According to an exemplary embodiment, the storage capacitor includes a first terminal and a second terminal, the first terminal of the storage capacitor is connected to a control terminal of the driving transistor, and each of the plurality of pixels further includes a fourth switching transistor which connects the second terminal of the storage capacitor to a reference voltage in response to an on-voltage of the compensation signal.

According to an exemplary embodiment, the compensation signal is in an on-voltage state before the scanning signal is in an on-voltage state, the light emitting signal is in an off-voltage state during a predetermined period of a period in which the compensation signal is in an on-voltage state, and the predetermined period is longer than a period in which the scanning signal is in an on-voltage state.

According to an exemplary embodiment, each of the plurality of pixels further includes an auxiliary capacitor which is connected to the storage capacitor.

In another exemplary embodiment, the present invention provides a display device including a scanning line which transfers a scanning signal, a light emitting signal line which transfers a light emitting signal, a compensation signal line which transfers a compensation signal, a data line which transfers a driving voltage, a light-emitting element, a storage capacitor which includes a first terminal and a second terminal, first, second and third switching transistors, and a driving transistor. According to an exemplar embodiment, the first switching transistor operates in response to the scanning signal and is connected between the data line and the first terminal of the storage capacitor, and the driving transistor includes a first terminal, a second terminal connected to the light-emitting element, and a control terminal connected to the second terminal of the storage capacitor. The second switching transistor operates in response to the compensation signal and is connected between the first terminal and the control terminal of the driving transistor, and the third switching transistor operates in response to the light emitting signal and is connected between a driving voltage and the first terminal of the driving transistor. According to an exemplary embodiment, a first period in which the second switching transistor is turned on in response to the compensation signal is longer than a second period in which the first switching transistor is turned on in response to the scanning signal.

According to an exemplary embodiment, the third switching transistor is turned off in response to the light emitting signal during a predetermined period of the first period, and the predetermined period is longer than the second period.

According to an exemplary embodiment, the display device further includes a light emitting driver which sequentially generates a plurality of light emitting outputs, which generates the light emitting signal with a first light emitting output of the plurality of light emitting outputs, and which generates the compensation signal by inverting a second light emitting output generated before the first light emitting output.

According to an exemplary embodiment, the display device further includes a light emitting driver which sequentially generates a plurality of compensation outputs, which generates the compensation signal with a first compensation output of the plurality of compensation outputs, and which generates the light emitting signal by inverting a second compensation output generated after the first compensation output.

According to an exemplary embodiment, the display device further includes a fourth switching transistor which operates in response to the compensation signal and which is connected between a reference voltage and the first terminal of the storage capacitor.

In another exemplary embodiment, the present invention provides a method of driving a display device which includes a driving transistor including a control terminal, a first terminal, and a second terminal, a light-emitting element emitting light according to a current that is supplied through a second terminal of the driving transistor, and a storage capacitor connected to the control terminal of the driving transistor. The method includes applying a reference voltage and a driving voltage to terminals of the storage capacitor, respectively, diode-connecting the driving transistor during a first period, applying a data voltage to the storage capacitor during a second period that is shorter than the first period, and transferring the driving voltage to the first terminal of the driving transistor.

According to an exemplary embodiment, the diode-connecting of the driving transistor includes intercepting the driving voltage during a third period of the first period, and the third period is longer than the second period.

According to an exemplary embodiment, the diode-connecting of the driving transistor further includes supplying a current to the light emitting element through the second terminal of the driving transistor.

According to an exemplary embodiment, the transferring of the driving voltage includes supplying a current to the light-emitting element through the second terminal of the driving transistor.

DETAILED DESCRIPTION OF THE INVENTION

Figure 1:
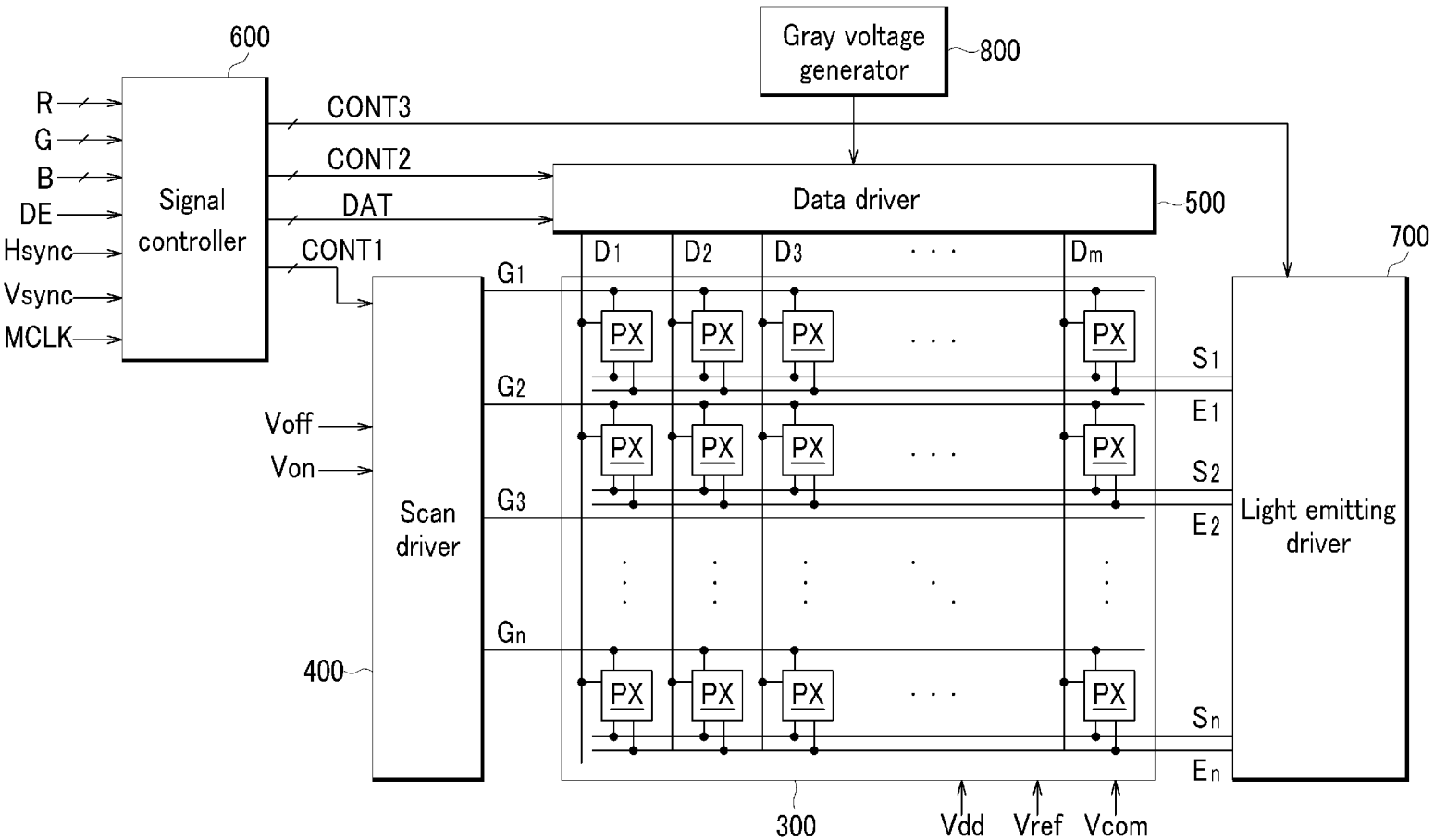
FIG. 1 is a block diagram of an exemplary embodiment of an organic light emitting display according to the present invention.

The invention is described more fully hereinafter with reference to the accompanying drawings, in which exemplary embodiments of the invention are shown. The present invention may, however, be embodied in many different forms and should not be construed as being limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

Figure 2:
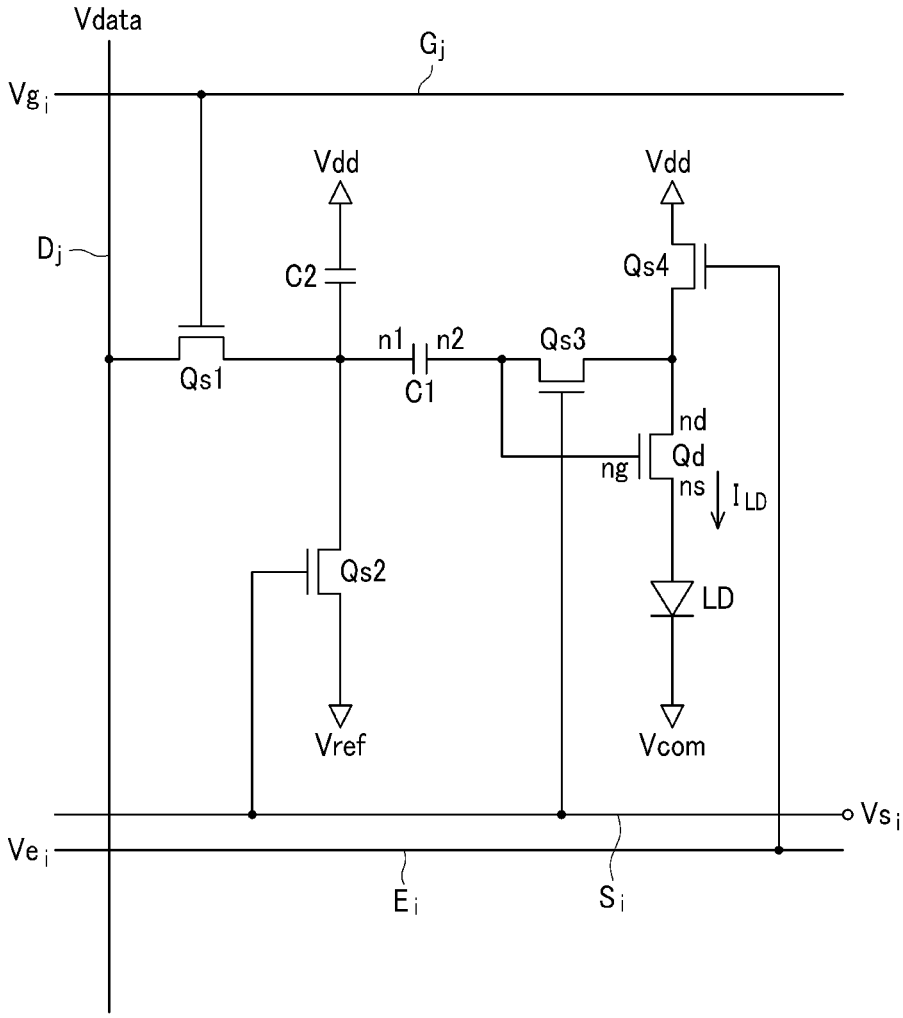
FIG. 2 is an equivalent circuit diagram of an exemplary embodiment of a pixel in an organic light emitting display according to the present invention.

Referring to FIGS. 1 and 2, a display device according to an exemplary embodiment of the present invention is described and in an exemplary embodiment of the present invention, and an organic light emitting display is described as an example of the display device.

Referring to FIGS. 1 and 2, the organic light emitting display according to an exemplary embodiment of the present invention is described in detail.

FIG. 1 is a block diagram of an exemplary embodiment of an organic light emitting display according to the present invention, and FIG. 2 is an equivalent circuit diagram of an exemplary embodiment of a pixel in an organic light emitting display according to the present invention.

Referring to FIG. 1, the organic light emitting display according to an exemplary embodiment of the present invention includes a display panel 300, a scan driver 400, a data driver 500, a light emitting driver 700, a gray voltage generator 800, and a signal controller 600.

Referring to FIG. 1, the display panel 300 includes a plurality of signal lines $G_1$-$G_n$, $D_1$-$D_m$, $E_1$-$E_n$, and $S_1$-$S_n$, a plurality of voltage lines (not shown), and a plurality of pixels PX which are connected thereto and arranged in an approximate matrix form.

According to an exemplary embodiment, the signal lines $G_1$-$G_n$, $D_1$-$D_m$, $E_1$-$E_n$, and $S_1$-$S_n$ include a plurality of scanning lines $G_1$-$G_n$ which transfer scanning signals $Vg_1$-$Vg_n$, a plurality of data lines $D_1$-$D_m$ which transfer a data voltage, a plurality of light emitting signal lines $E_1$-$E_n$ which transfer light emitting signals $Ve_1$-$Ve_n$, and a plurality of compensation signal lines $S_1$-$S_n$ which transfer compensation signals $Vs_1$-$Vs_n$. The scanning lines $G_1$-$G_n$, the light emitting signal lines $E_1$-$E_n$, and the compensation signal lines $S_1$-$S_n$ are extended in a horizontal direction and are substantially parallel to each other, and the data lines $D_1$-$D_m$ are extended in a vertical direction and are substantially parallel to each other.

The voltage line includes a driving voltage line (not shown) which transfers a driving voltage Vdd and a reference voltage line (not shown) which transfers a reference voltage Vref.

Referring to FIG. 2, each pixel PX, for example, a pixel PX which is connected to an i-th (i=1, 2, . . . , n) scanning line $G_i$ and a j-th (j=1, 2, . . . , m) data line $D_j$, comprises an organic light emitting element LD, a driving transistor Qd, a storage capacitor C1, an auxiliary capacitor C2, and switching transistors Qs1-Qs4.

The driving transistor Qd is a three terminal element having a control terminal ng, an input terminal nd, and an output terminal ns, and the switching transistors Qs1-Qs4 are also three terminal elements having a control terminal, an input terminal, and an output terminal.

The control terminal of the switching transistor Qs1 is connected to a scanning line $G_i$, the input terminal thereof is connected to a data line $D_j$, and the output terminal thereof is connected to one terminal n1 of the storage capacitor C1. The other terminal n2 of the storage capacitor C1 is connected to the control terminal ng of the driving transistor Qd. The switching transistor Qs1 transfers a data voltage applied to the data line $D_j$ in response to a scanning signal $Vg_i$ applied to the scanning line $G_i$, and the storage capacitor C1 charges a voltage according to a data voltage and sustains the charge after the switching transistor Qs1 is turned off. The auxiliary capacitor C2 is connected between the storage capacitor C1 and a driving voltage line which supplies a driving voltage Vdd to for stabilizing a voltage of a terminal n1 of the storage capacitor C1, and a voltage of the control terminal ng of the driving transistor Qd.

The control terminal of the switching transistor Qs2 is connected to a compensation signal line $S_i$, an input terminal thereof is connected to one terminal n1 of the storage capacitor C1, and an output terminal thereof is connected to a reference voltage line. The switching transistor Qs2 transfers a reference voltage Vref to the storage capacitor C1 in response to a compensation signal $Vs_i$ that is applied to the compensation signal line $S_i$.

The control terminal of the switching transistor Qs3 is connected to the compensation signal line $S_i$, and the input terminal and the output terminal thereof are connected to the control terminal ng and the input terminal nd of the driving transistor Qd, respectively. The switching transistor Qs3 connects the control terminal ng and the input terminal nd of the driving transistor Qd, i.e., diode-connects the driving transistor Qd in response to the compensation signal $Vs_i$.

The control terminal ng of the driving transistor Qd is connected to the other terminal n2 of the storage capacitor C1, the input terminal nd thereof is connected to the switching transistor Qs4, and the output terminal ns thereof is connected to an organic light emitting element LD. The driving transistor Qd flows an output current $I_{LD}$ having a different magnitude according to a voltage formed between the control terminal ng and the output terminal ns.

The control terminal of the switching transistor Qs4 is connected to a light emitting signal line $E_i$, the input terminal thereof is connected to a driving voltage line which supplies a driving voltage Vdd, and the output terminal thereof is connected to the driving transistor Qd. The switching transistor Qs4 transfers a driving voltage Vdd in response to a light emitting signal $Ve_i$ applied to the light emitting signal line $E_i$.

According to an exemplary embodiment, the organic light emitting element LD is an OLED, and comprises an anode which is connected to the output terminal of the driving transistor Qd and a cathode which is connected to a common voltage Vcom. The organic light emitting element LD displays an image by emitting light with different intensities according to an output current $I_{LD}$ of the driving transistor Qd.

According to an exemplary embodiment, the organic light emitting element LD emits light of one of primary colors. An example of a set of the primary colors includes a red color, a green color, and a blue color, and a desired color can be displayed with a spatial or temporal combination of the primary colors. In the current exemplary embodiment, some of the organic light emitting elements LD emit light of a white color, thereby increasing luminance. Alternatively, according to another exemplary embodiment, an organic light emitting element LD of all pixels PX emits light of a white color, and some pixels PX further include a color filter (not shown) which changes white light that is emitted from the organic light emitting element LD to light of one primary color.

In the current exemplary embodiment, the switching transistors Qs1-Qs4 and the driving transistor Qd are n-channel field effect transistors ("FETs") made of amorphous silicon or a polysilicon. However, according to another exemplary embodiment, at least one of the switching and driving transistors Qs1-Qs4, and Qd may be a p-channel FET. Further, according to an exemplary embodiment, a connection relationship of the transistors Qs1-Qs4, and Qd, the capacitors C1 and C2, and the organic light emitting element LD may be changed.

Referring again to FIG. 1, the gray voltage generator 800 generates all gray voltages which are related to luminance of the pixel PX or gray voltages (hereinafter referred to as "reference gray voltages") of a limited number.

The scan driver 400 is connected to the scanning lines $G_1$-$G_n$ of the display panel 300, and applies a scanning signal formed with a combination of an on-voltage Von that can turn on and an off-voltage Voff that can turn off the switching transistor Qs1 to the scanning lines $G_1$-$G_n$. In the current exemplary embodiment, when the switching transistor Qs1 is an n-channel FET, the on-voltage Von and the off-voltage Voff are a high voltage and a low voltage, respectively.

The data driver 500 is connected to the data lines $D_1$-$D_m$ of the display panel 300, selects a gray voltage from the gray voltage generator 800, and applies the gray voltage to the data lines $D_1$-$D_m$ as a data voltage. However, when the gray voltage generator 800 does not provide all gray voltages but provides only reference gray voltages of the limited number, the data driver 500 generates a desired data voltage by dividing the reference gray voltages.

The light emitting driver 700 is connected to light emitting signal lines $E_1$-$E_n$ of the display panel 300, and applies light emitting signals $Ve_1$-$Ve_n$ formed with a combination of a voltage that can turn on and a voltage that can turn off the switching transistor Qs4 to the light emitting signal lines $E_1$-$E_n$. The light emitting driver 700 is also connected to the compensation signal lines $S_1$-$S_n$ of the display panel 300, and applies compensation signals $Vs_1$-$Vs_n$ formed with a combination of a voltage that can turn on and a voltage that can turn off the switching transistors Qs2 and Qs3 to the compensation signal lines $S_1$-$S_n$.

According to an exemplary embodiment, all of the switching transistors Qs1-Qs4 are turned on with the same high voltage Von and turned off with the same low voltage Voff.

The signal controller 600 controls the scan driver 400, the data driver 500, and the light emitting driver 700.

According to an exemplary embodiment, the scan driver 400, the data driver 500, the signal controller 600, light emitting driver 700, and the gray voltage generator 800 may be directly mounted on the display panel 300 in a form of at least one IC chip, be mounted on a flexible printed circuit film (not shown) to be attached to the display panel 300 in a form of a tape carrier package (TCP), or be mounted on a separate printed circuit board (PCB) (not shown). Alternatively, according to an exemplary embodiment, the scan driver 400, the data driver 500, the signal controller 600, light emitting driver 700, and the gray voltage generator 800 may be integrated in the display panel 300 together with the signal lines $G_1$-$G_n$, $D_1$-$D_m$, $E_1$-$E_n$, and $S_1$-$S_n$ and the TFTs Qs1-Qs4, and Qd. Further, according to another exemplary embodiment, the scan driver 400, the data driver 500, the signal controller 600, light emitting driver 700, and the gray voltage generator 800 may be integrated in a single chip, and in this case, at least one of the driving units or at least one circuit element constituting them may be disposed at the outside of a single chip.

An operation of the organic light emitting display is described in detail with reference to FIGS. 3, 4, 5, 6 and 7.

Figure 3:
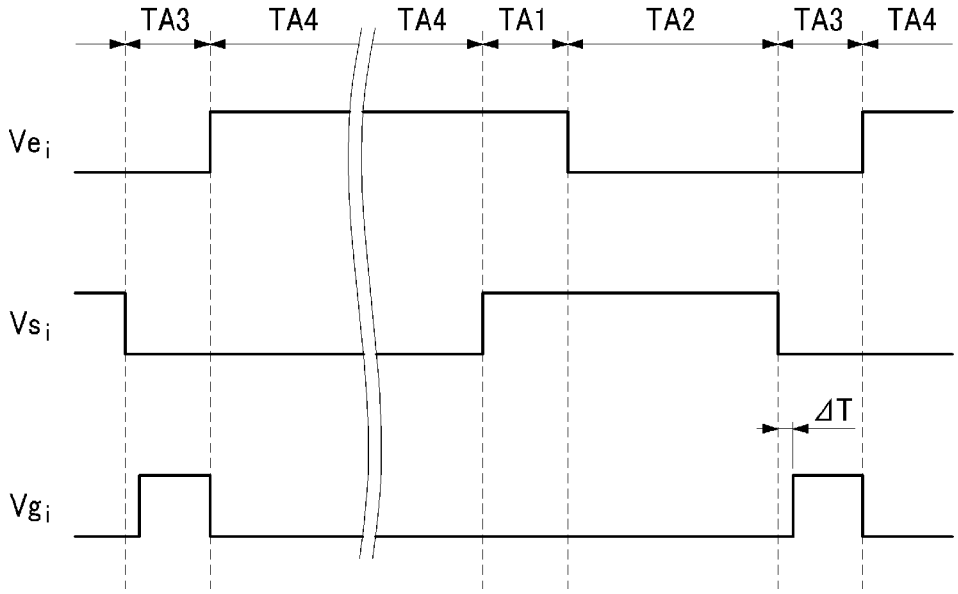
FIG. 3 is a timing diagram illustrating an exemplary embodiment of a driving signal of an organic light emitting display according to the present invention.

FIG. 3 is a timing diagram illustrating an exemplary embodiment of a driving signal of an organic light emitting display according to an the present invention. FIGS. 4, 5, 6 and 7 are equivalent circuit diagrams of an exemplary embodiment of a pixel in each period shown in FIG. 3.

As shown in FIG. 1, the signal controller 600 receives input image signals R, G, and B and an input control signal which controls the display of the input image signals R, G, and B from an external graphics controller (not shown). The input image signals R, G, and B include luminance information of each pixel PX, and luminance has grays of a predetermined number, for example, 1024 ($=2^{10}$), 256 ($=2^8$), or 64 ($=2^6$). The input control signal includes, for example, a vertical synchronization signal Vsync, a horizontal synchronization signal Hsync, a main clock signal MCLK, and a data enable signal DE.

The signal controller 600 processes the input image signals R, G, and B to correspond to an operating condition of the display panel 300 based on the input image signals R, G, and B and one of the input control signals, generates a scanning control signal CONT1, a data control signal CONT2, and a light emitting control signal CONT3, then sends the scanning control signal CONT1 to the scan driver 400, sends the data control signal CONT2 and the processed digital image signal DAT to the data driver 500, and sends the light emitting control signal CONT3 to the light emitting driver 700.

The scanning control signal CONT1 includes a scanning start signal STV which instructs the start of scanning and at least one clock signal which controls an output period of the high voltage Von. The scanning control signal CONT1 further includes an output enable signal OE which limits a sustain time of a high voltage Von of the scanning signals $Vg_1$-$Vg_n$.

The data control signal CONT2 includes a horizontal synchronization start signal STH which notifies the transfer start of a digital image signal DAT for one row of pixels PX, and a load signal and a data clock signal HCLK which apply a data voltage to the data lines $D_1$-$D_m$.

The data driver 500 receives the digital image signal DAT for one row of pixels PX according to the data control signal CONT2 from the signal controller 600, converts the digital image signal DAT to a digital voltage by selecting a gray voltage corresponding to each digital image signal DAT, and then applies the data voltage to the corresponding data lines $D_1$-$D_m$.

The light emitting driver 700 stores a threshold voltage in a capacitor C1 of a pixel PX connected to the compensation signal lines $S_1$-$S_n$ by sequentially applying a high voltage Von of the compensation signals $Vs_1$-$Vs_n$ to the compensation signal lines $S_1$-$S_n$ according to the light emitting control signal CONT3 from the signal controller 600.

Thereafter, the scan driver 400 turns on a switching transistor Qs1 connected to the scanning lines $G_1$-$G_n$ by sequentially applying a high voltage Von of the scanning signals $Vg_1$-$Vg_n$ to the scanning lines $G_1$-$G_n$ according to the scan control signal CONT1 from the signal controller 600. Accordingly, a data voltage which is applied to data lines $D_1$-$D_m$ is transferred to the corresponding pixel PX through the turned-on switching transistor Qs1 to be stored in the capacitor C1.

The scanning signals $Vg_1$-$Vg_n$ have a high voltage Von for one horizontal period (referred to as "1H", the same as one period of a horizontal synchronizing signal Hsync and a data enable signal DE), or have a high voltage Von for a period shorter than 1H as the scanning signals $Vg_1$-$Vg_n$ are limited by the output enable signal OE. The compensation signals $Vs_1$-$Vs_n$ have a high voltage Von for a period longer than approximately 1H.

The light emitting driver 700 turns on a switching transistor Qs4 connected to the light emitting signal lines $E_1$-$E_n$ by sequentially applying a high voltage Von of light emitting signals $Ve_1$-$Ve_n$ to the light emitting signal lines $E_1$-$E_n$ according to the light emitting control signal CONT3. Accordingly, the driving transistor Qd generates an output current $I_{LD}$ corresponding to a voltage that is stored in the capacitor C1. The organic light emitting element LD emits light of an intensity corresponding to the output current $I_{LD}$ of the driving transistor Qd.

The displaying an image in an i-th row of pixel is described in detail hereinafter with reference to FIGS. 3 to 7.

Referring to FIG. 3, while a light emitting signal $Ve_i$ sustains a high voltage Von and a scanning signal $Vg_i$ sustains a low voltage Voff, when the light emitting driver 700 causes a compensation signal $Vs_i$ to be a high voltage Von according to the light emitting control signal CONT3, switching transistors Qs2 and Qs3 which are connected to the compensation signal line $S_i$ are turned on. Therefore, a switching transistor Qs4 that is connected to the light emitting signal line $Ve_i$ sustains a turn-on state, and a switching transistor Qs1 connected to the scanning line $Vg_i$ sustains a turn-off state.

Figure 4:
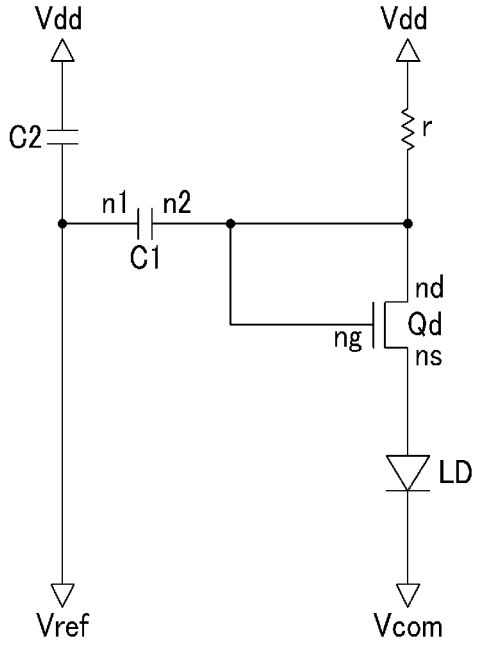
FIGS. 4, 5, 6 and 7 are equivalent circuit diagrams of an exemplary embodiment of a pixel in each period that is shown in FIG. 3.

An equivalent circuit of a pixel in such a state is shown in FIG. 4, and this period is referred to as a pre-charge period TA1 (shown in FIG. 3). As shown in FIG. 4, the turned-on switching transistor Qs4 is represented with a resistor r.

Accordingly, since one terminal n2 of the capacitor C1 and a control terminal ng of the driving transistor Qd are connected to a driving voltage Vdd through the resistor r, a voltage thereof is a value of a subtraction of a voltage drop amount due to the resistor r from the driving voltage Vdd, the other terminal n1 of the capacitor C1 is connected to a reference voltage Vref to be initialized to the reference voltage Vref, and the capacitor C1 sustains a voltage difference of both ends. In this case, the driving voltage Vdd is fully higher than an output terminal voltage Vns of the driving transistor Qd to turn on the driving transistor Qd.

Therefore, the driving transistor Qd is turned on to supply a current to the organic light emitting element LD through the output terminal ns and thus, the organic light emitting element LD emits light. However, since a length of the pre-charge period TA1 is much smaller than one frame, light emitting of the organic light emitting element LD is not viewed in the pre-charge period TA1 and has minimal influence on luminance of display.

Thereafter, when the light emitting driver 700 turns off a switching transistor Qs4 by changing the light emitting signal $Ve_i$ to a low voltage Voff according to the light emitting control signal CONT3, a compensation period TA2 starts. The compensation signal $Vs_i$ continuously sustains a high voltage Von in the compensation period TA2, and thus, the switching transistors Qs2 and Qs3 are sustained in an on-state.

Figure 5:
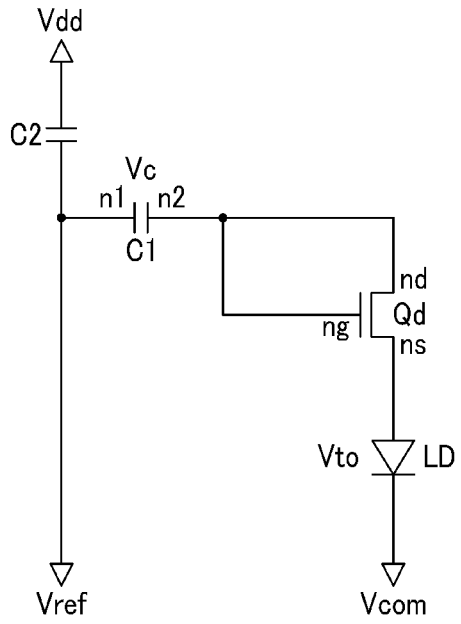

Accordingly, as shown in FIG. 5, the driving transistor Qd is separated from the driving voltage Vdd and is diode-connected. Since a control terminal voltage Vng of the driving transistor Qd is fully high, a driving transistor Qd which is separated from the driving voltage Vdd sustains a turn-on state.

Accordingly, electric charges which are charged to a terminal n2 of the capacitor C1 that has been charged to a predetermined level in the pre-charge period TA1 start the discharge through the driving transistor Qd and the organic light emitting element LD, and thus, the control terminal voltage Vng of the driving transistor Qd is lowered. In the current exemplary embodiment, the light emitting driver 700 according to an exemplary embodiment of the present invention, controls the light emitting signal $Ve_i$ and the compensation signal $Vs_i$ so that a length of the compensation period TA2 is longer than approximately 1H. Accordingly, even when a current flowing to the driving transistor Qd decreases because the control terminal voltage Vng is lowered, a length of the compensation period TA2 is long (see FIG. 3), so that a voltage drop of the control terminal voltage Vng is continuously performed until a voltage between the control terminal ng and the output terminal ns of the driving transistor Qd is identical to a threshold voltage Vth of the driving transistor Qd, i.e., the driving transistor Qd no longer flows a current. In the current exemplary embodiment, a voltage between an anode and a cathode of the organic light emitting element LD becomes a threshold voltage Vto of the organic light emitting element LD.

Therefore, the control terminal voltage Vng of the driving transistor Qd is represented by Equation 1, and a voltage Vc that is charged to the capacitor C1 satisfies Equation 2.

$$Vng = Vth + Vto + Vcom \quad \text{(Equation 1)}$$

$$Vc = Vth + Vto + Vcom - Vref \quad \text{(Equation 2)}$$

It can be seen through Equation 2 that the capacitor C1 stores a voltage depending on a threshold voltage Vth of the driving transistor Qd and a threshold voltage Vto of the organic light emitting element LD.

After the voltage Vc is charged to the capacitor C1, when the light emitting driver 700 turns off switching transistors Qs2 and Qs3 by changing a compensation signal $Vs_i$ to a low voltage, a recording period TA3 starts (see FIG. 3). The light emitting signal $Ve_i$ continuously sustains a low voltage Voff even in the recording period TA3 and thus the switching transistor Qs4 sustains an off-state.

The data driver 500 sequentially receives a digital image signal DAT for an i-th row of the pixel PX according to the data control signal CONT2 from the signal controller 600, and then applies a data voltage Vdata corresponding to each digital image signal DAT to the corresponding data lines $D_1$-$D_m$.

The scan driver 400 turns on the switching transistor Qs1 by causing a voltage value of a scanning signal $Vg_i$ to be a high voltage Von at a starting time of the recording period TA3 or after a predetermined delay time ΔT has elapsed from the starting time of the recording period TA3.

Figure 6:
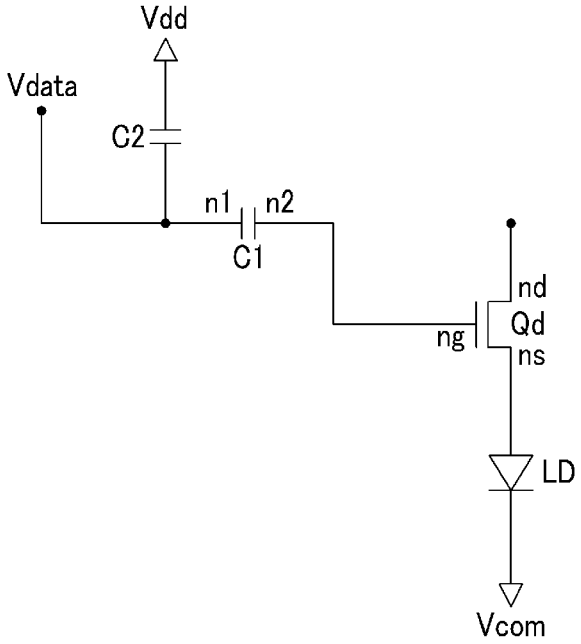

Accordingly, as shown in FIG. 6, an input terminal nd of the driving transistor Qd is opened, and a terminal n2 of the capacitor C1 is connected to the data voltage Vdata. Accordingly, a control terminal voltage Vng is changed to a voltage of Equation 3 by a bootstrapping effect by the capacitor C1.

$$Vng=Vth+Vto+Vcom+(Vdata-Vref)\times C1/(C1+C') \quad \text{(Equation 3)}$$

Here, the capacitor and capacity of the capacitor use the same reference numeral, and C' indicates a total parasitic capacity that is formed in the control terminal ng of the driving transistor Qd.

If C1 is much greater than C', a control terminal voltage Vng of the driving transistor Qd is represented by Equation 4.

$$Vng=Vth+Vto+Vcom+Vdata-Vref \quad \text{(Equation 4)}$$

While continuously sustaining a voltage Vc that is charged in the compensation period TA2 as in Equation 2 in the recording period TA3, the capacitor C1 performs a function of transferring a data voltage Vdata to the control terminal ng of the driving transistor Qd.

The capacitor C2 stabilizes a voltage of a terminal n1 of the capacitor C1 and the control terminal voltage Vng of the driving transistor Qd. Alternatively, according to an exemplary embodiment, one terminal of the capacitor C2 may be connected to the control terminal ng of the driving transistor Qd instead of a terminal n2 of the capacitor C1 and if so, the other terminal of the capacitor C2 which is connected to the driving voltage Vdd may be connected to a terminal having a reference voltage Vref, a common voltage Vcom, or a separate predetermined potential. Therefore, Equation 4 changes to Equation 5.

$$Vng=Vth+Vto+Vcom+(Vdata-Vref)\times C1/(C1+C2) \quad \text{(Equation 5)}$$

Since a size of an item including a data voltage Vdata decreases, when an image signal is processed to display desired luminance, it is required to suitably adjust a size thereof.

According to an exemplary embodiment, the capacitor C2 may be omitted as necessary.

When the light emitting driver 700 turns on a switching transistor Qs4 by changing the light emitting signal $Ve_i$ to a high voltage Von according to the light emitting control signal CONT3 and when the scan driver 400 turns off the switching transistor Qs1 by changing the scanning signal $Vg_i$ to a low voltage Voff according to the scan control signal CONT1, a light emitting period TA4 starts. Since the compensation signal $Vs_i$ continuously sustains a low voltage Voff even in the light emitting period TA4, the switching transistors Qs2 and Qs3 sustain an off-state.

Figure 7:
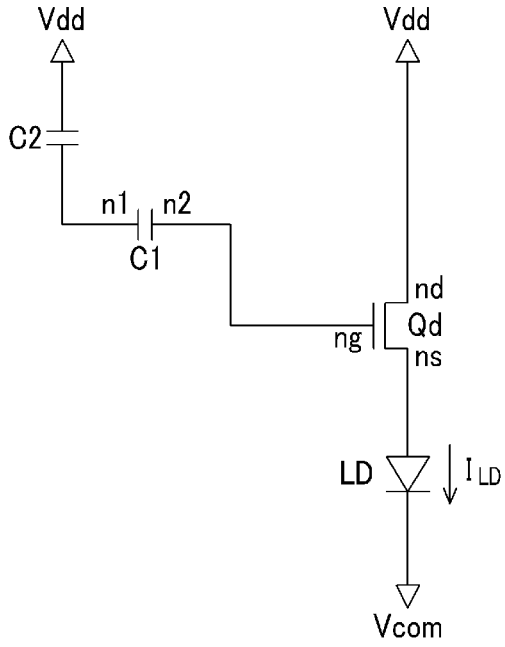

Accordingly, as shown in FIG. 7, a terminal n1 of a capacitor C1 is separated from the data voltage Vdata, and the driving voltage Vdd is connected to the input terminal nd of the driving transistor Qd. In this state, since electric charges cannot be discharged from and injected to the capacitor C1, the capacitor C1 continuously sustains a charged voltage Vc and the control terminal voltage Vng of the driving transistor Qd also sustains a voltage of Equation 4.

Accordingly, the driving transistor Qd supplies an output current $I_{LD}$ which is controlled by a voltage Vgs between the control terminal voltage Vng and an output terminal voltage Vns to the organic light emitting element LD through an output terminal ns. Accordingly, the organic light emitting element LD displays the corresponding image by emitting light with different intensities according to a magnitude of the output current $I_{LD}$. According to an exemplary embodiment, the output current $I_{LD}$ is represented as follows:

$$\begin{aligned} I_{LD} &= \frac{1}{2}k(Vgs-Vth)^2 \\ &= \frac{1}{2}k(Vng-Vns-Vth)^2 \\ &= \frac{1}{2}k(Vto+Vcom+Vdata-Vref-Vns)^2 \end{aligned} \quad \text{(Equation 6)}$$

In Equation 6, k is a constant according to characteristics of a TFT, $k\text{-}\mu C_{SiNx}(W/L)$, μ is electric field effect mobility, $C_{SiNx}$ is capacity of an insulating layer, W is a channel width of the TFT, and L is a channel length of the TFT.

According to Equation 4 and Equation 6, the output current $I_{LD}$ is not influenced by a threshold voltage Vth of the driving transistor Qd. That is, even if there is a deviation in a threshold voltage of driving transistors Qd in the display panel or a threshold voltage of the driving transistor Qd changes, the output current $I_{LD}$ is equally sustained.

In the organic light emitting element, as a current flows for a long time period, the threshold voltage can be changed. When the driving transistor Qd is an n-type transistor, if the threshold voltage of an organic light emitting element is deteriorated, a voltage of an output terminal ns of the driving transistor Qd, i.e., a source side, may be changed. However, according to Equation 6, when the threshold voltage Vto of the organic light emitting element LD changes by ΔVto, a voltage Vng including the change amount ΔVto is charged to the control terminal ng in a compensation period TA2, and an output terminal voltage Vns of the driving transistor Qd is also changed by the change amount ΔVto. Therefore, because the change amount ΔVto is included in and eliminated from each item of Vng and Vns in Equation 6, the output current $I_{LD}$ does not change.

Finally, even when a deviation is generated in the threshold voltage Vth of the driving transistor Qd and the threshold voltage Vto of the organic light emitting element LD, the organic light emitting display according to the present exemplary embodiment can compensate the deviation.

By turning on the switching transistor Qs4 through changing a light emitting signal $Ve_i$ to a high voltage Von in a recording period TA3 as needed, the organic light emitting element LD may emit light. In this case, the switching transistor Qs4 is turned on after turning off the switching transistor Qs3.

The light emitting period TA4 is sustained until a precharge period TA1 for an i-th row of a pixel again starts in a next frame, and an operation in each of the periods TA1-TA4 that are described above is equally repeated in a pixel of a next row. Thus, the corresponding image is displayed in all pixels by sequentially performing a control of periods TA1-TA4 for all scanning signal lines $G_1$-$G_n$, light emitting signal lines $E_1$-$E_n$, and compensation signal lines $S_1$-$S_n$.

According to an exemplary embodiment, a reference voltage Vref may be set to a same voltage level as a common voltage Vcom, for example approximately 0V. Alternatively, according to another exemplary embodiment, the reference voltage Vref may be set to have a negative voltage level. Accordingly, the data driver 500 can be driven by reducing a magnitude of a data voltage Vdata which is applied to a pixel. Otherwise, the overall luminance of the display panel 300 is adjusted by adjusting the reference voltage Vref according to characteristics of the display panel 300.

Particularly, as the size of the display panel 300 increases, a value of a driving voltage Vdd can be differently displayed in a row or column direction due to a resistance value of a driving voltage line, and in this case, when a reference voltage Vref is differently applied to a row or a column, luminance of the display panel 300 can be entirely uniformly adjusted.

According to an exemplary embodiment, a driving voltage Vdd is set to a maximum high voltage in order to fully supply electric charges to the capacitor C1 and to allow the driving transistor Qd to flow the output current $I_{LD}$.

A light emitting driver of an organic light emitting display according to an exemplary embodiment of the present invention is described with reference to FIGS. 8 and 9.

Figure 8:
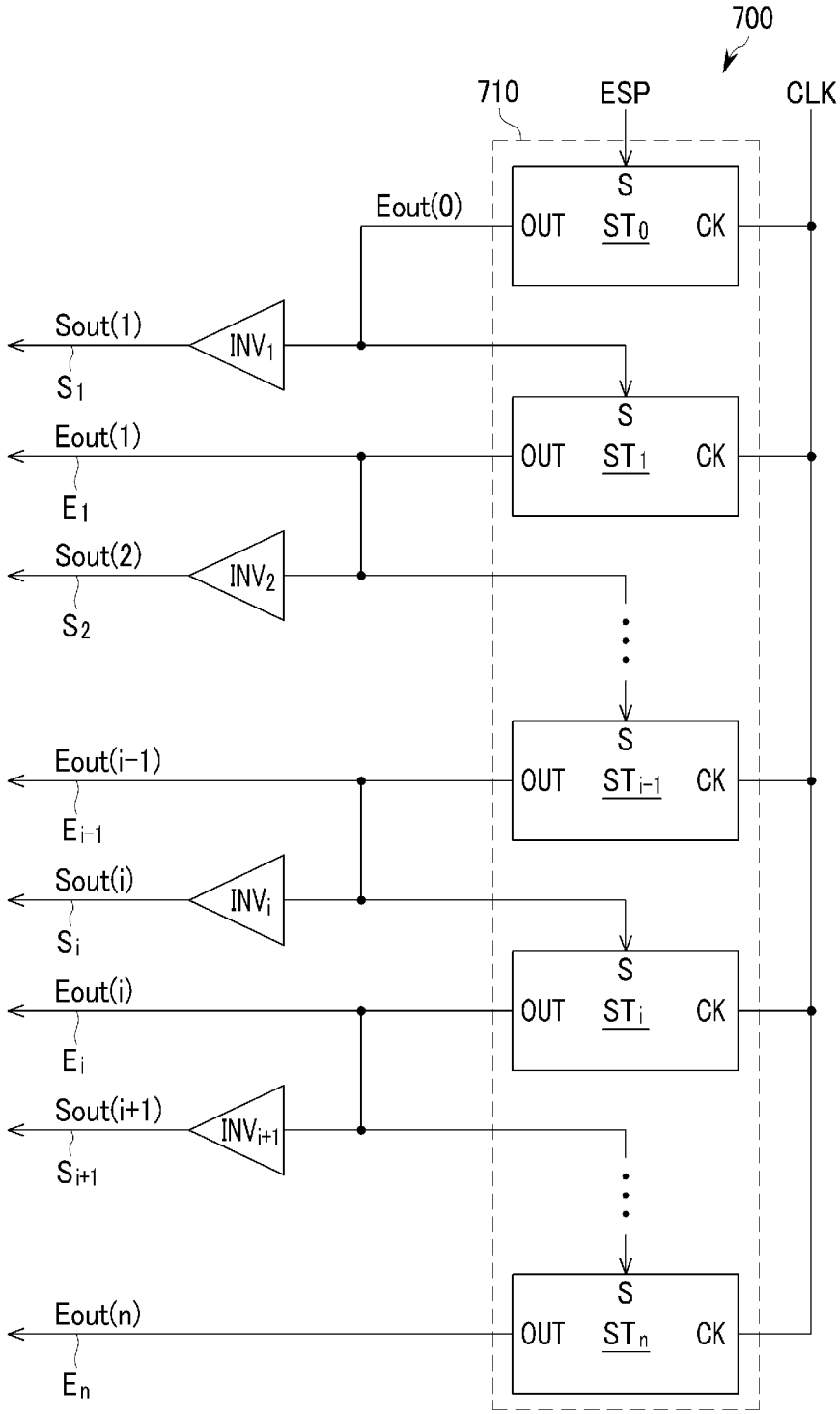
FIG. 8 is a block diagram of an exemplary embodiment of a light emitting driver of an organic light emitting display according to the present invention.
Figure 9:
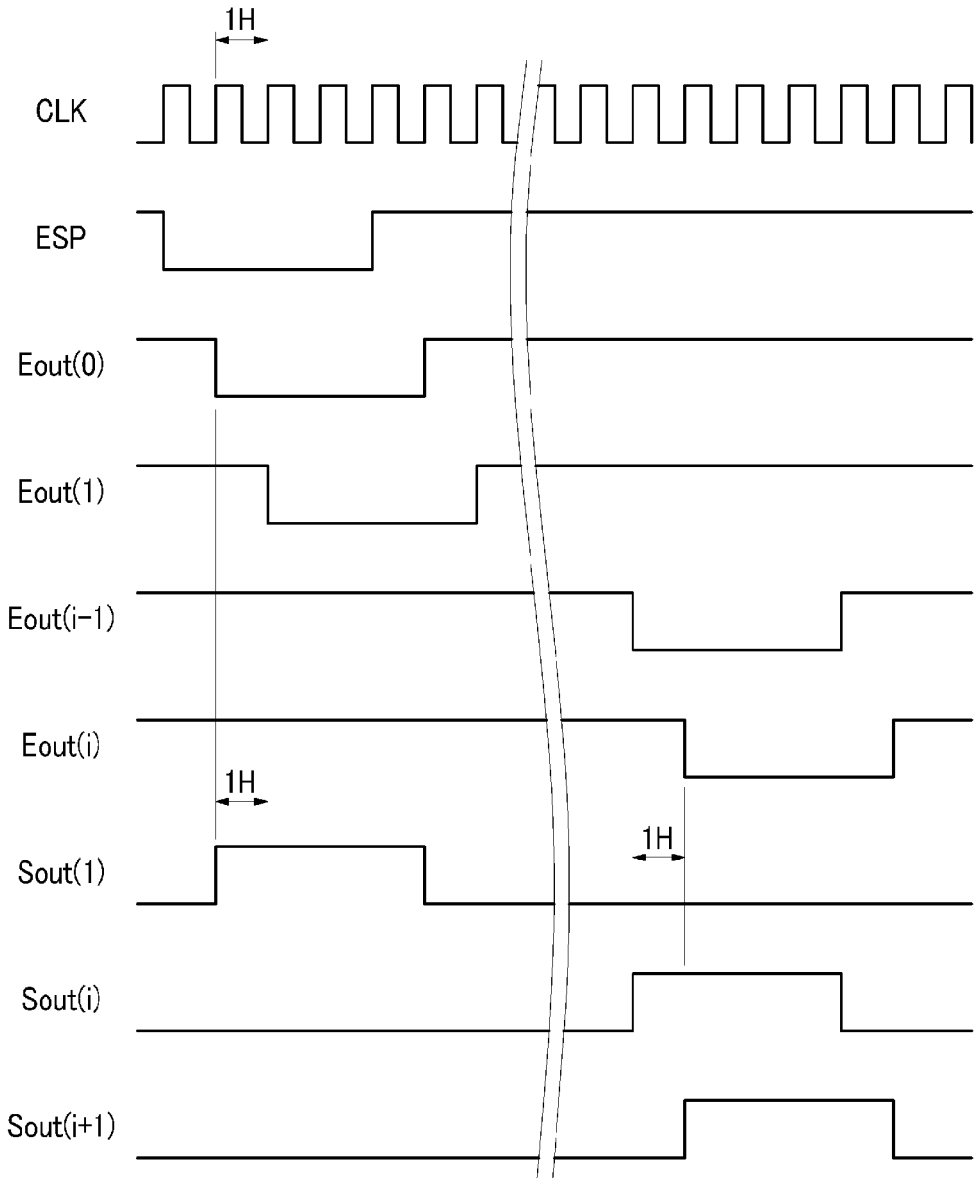
FIG. 9 is a timing diagram of an exemplary embodiment of an output signal of the light emitting driver that is shown in FIG. 8.

FIG. 8 is a block diagram of a light emitting driver of an organic light emitting display according to an exemplary embodiment of the present invention, and FIG. 9 is a timing diagram of an output signal of the light emitting driver that is shown in FIG. 8.

Referring to FIG. 8, the light emitting driver 700 includes a shift register 710 and a plurality of inverters $INV_1$-$INV_n$.

A light emitting control signal CONT3 from the signal controller 600 is applied to the shift register 710, and the shift register 710 includes a plurality of stages $ST_0$-$ST_n$. Each of the stages $ST_0$-$ST_n$ includes a set terminal S, an output terminal OUT, and a clock terminal CK, and the output terminals OUT of the plurality of stages $ST_0$-$ST_n$ becomes output terminals of the shift register 710. All stages $ST_1$-$ST_n$ except for a first stage $ST_0$ are connected one-to-one to light emitting signal lines $E_1$-$E_n$, and all stages $ST_0$-$ST_{n-1}$ except for a final stage $ST_n$ are respectively connected to the compensation signal lines $S_1$-$S_n$ via the inverters $INV_1$-$INV_n$.

Input terminals of the inverters $INV_1$-$INV_n$ are respectively connected to output terminals OUT of the stages $ST_0$-$ST_{n-1}$, and output terminals of the inverters $INV_1$-$INV_n$ are respectively connected to the compensation signal lines $S_1$-$S_n$.

A light emitting output Eout(i−1) of a previous stage $ST_{i-1}$ is input to a set terminal S of each of the stages $ST_0$-$ST_n$, for example an i-th stage $ST_i$, and a clock signal CLK among the light emitting control signal CONT3 is input to a clock terminal CK. Accordingly, each stage $ST_i$ generates a light emitting output Eout(i) having a low voltage in synchronization with the clock signal CLK which is input to the clock terminal CLK.

A light emitting start pulse ESP among the light emitting control signal CONT3 is input to a set terminal of the first stage $ST_0$.

Referring to FIG. 9, the first stage $ST_0$ outputs a low voltage of the light emitting start pulse ESP as a light emitting output Eout(0) for several cycles of the clock signal CLK corresponding to the compensation period TA2 in response to a high voltage of the clock signal CLK. Each stage, for example an i-th stage $ST_i$ outputs an output of the previous stage $ST_{i-1}$ i.e. a low voltage of a previous light emitting output Eout(i−1) as a light emitting output Eout(i) for several cycles of the clock signal CLK in response to a high voltage of the clock signal CLK. In the current exemplary embodiment, one cycle of the clock signal CLK is equal to approximately 1H.

Thus, a plurality of stages $ST_0$-$ST_n$ sequentially output a light emitting output Eout(0)-Eout(n) having a low voltage for several cycles of the clock signal CLK, and a low voltage of two adjacent light emitting outputs Eout(i−1) and Eout(i) is shifted by the 1H.

An inverter $INV_i$ connected to a compensation signal line $S_i$ of an i-th row generates a compensation output Sout(i) by inverting an output of the previous stage $ST_{i-1}$, i.e. a previous light emitting output Eout(i−1). Accordingly, a high voltage of an i-th compensation output Sout(i) advances earlier by approximately 1H than a low voltage of an i-th light emitting signal Eout(i) and has a same width as that of a low voltage of the light emitting signal Eout(i).

The light emitting driver 700 sets the light emitting outputs Eout(1)-Eout(n) and compensation outputs Sout(1)-Sout(n) as light emitting signals $Ve_1$-$Ve_n$ and compensation signals $Vs_1$-$Vs_n$ respectively, and transfers the light emitting outputs Eout(1)-Eout(n) and compensation outputs Sout(1)-Sout(n) to the light emitting signal lines $E_1$-$E_n$ and the compensation signal lines $S_1$-$S_n$, respectively. Thereafter, as shown in FIG. 3, according to an exemplary embodiment, a pre-charge period TA1 and a compensation period TA2 is set, and in this case, a length of the pre-charge period TA1 corresponds to approximately 1H, and a length of the compensation period TA2 corresponds to several times of the 1H.

In an exemplary embodiment of the present invention, although the light emitting driver 700 generates a compensation signal by inverting a light emitting signal, the light emitting driver 700 may generate a light emitting signal by inverting a compensation signal. Thus, each stage $ST_i$ sends a compensation output Sout(i), and an inverter that is connected to a light emitting signal line $E_i$ of an i-th row generates a light emitting output Eout(i) by inverting an output of a next stage $ST_{i+1}$, i.e., a next compensation output Sout(i+1).

According to an exemplary embodiment, the shift register 710 further includes a level shifter (not shown) and/or an output buffer (not shown). Accordingly, the level shifter changes a high voltage and a low voltage of the light emitting output Eout(i) of each stage $ST_i$ to an on-voltage Von and an off-voltage Voff, respectively, and outputs the on-voltage Von and the off-voltage Voff, and the output buffer transfers an output of the level shifter or each stage $ST_i$ to the light emitting signal line $E_i$. In this case, each inverter $INV_i$ may be connected between the output terminal of each stage $ST_i$ and the input terminal of the output buffer or the level shifter.

Further, in an exemplary embodiment of the present invention, the shift register shown in FIGS. 8 and 9 is exemplified, but the light emitting driver 700 uses a different form of shift register. For example, according to one exemplary embodiment, the light emitting driver 700 may use a shift register which shifts a light emitting output or a compensation output by a half cycle of the clock signal CLK and which outputs the shifted light emitting output or compensation output. Thus, a clock signal CLK and an inversion clock signal to which the clock signal CLK is inverted are input to the shift register. When the clock signal CLK is input to a clock terminal of one stage, an inversion clock signal can be input to a clock terminal of another stage adjacent thereto.

As described above, according to an exemplary embodiment of the present invention, by storing a threshold voltage of a driving transistor in a capacitor for an extended period of time, even if a deviation is generated between a threshold voltage of the driving transistor and a threshold voltage of an organic light emitting element, the deviation can be compensated. Further, by generating some of several signals necessary for compensating a threshold voltage of the driving transistor using other signals, a driver can be simply formed.

While the present invention has been shown and described with reference to some exemplary embodiments thereof, it should by understood by those of ordinary skill in the art that various changes in form and details may be made therein without departing from the spirit and scope of the present invention as defined by the appended claims.

What is claimed is:

1. A display device comprising a plurality of pixels, each comprising:

a light-emitting element;

a storage capacitor;

a driving transistor which comprises a control terminal, an input terminal, and an output terminal and supplies a driving current to the light-emitting element to emit light;

a first switching transistor which supplies a data voltage to the storage capacitor in response to an on-voltage of a scanning signal;

a second switching transistor which diode-connects the driving transistor in response to an on-voltage of a compensation signal;

a third switching transistor which supplies a driving voltage to the driving transistor in response to an on-voltage of a light emitting signal;

a first light emitting signal line which transfers the light emitting signal to a first pixel of the plurality of pixels;

a first compensation signal line which transfers the compensation signal to the first pixel;

a second light emitting signal line which transfers the light emitting signal to the second pixel of the plurality of pixels;

a second compensation signal line which transfers the compensation signal to the second pixel; and a light emitting driver which generates the light emitting signal, sequentially applies the light emitting signal to the first the second light emitting signal lines and generates the compensation signal and sequentially applies the compensation signal to the first and second compensation signal lines, wherein the storage capacitor stores a control voltage depending on a threshold voltage of the driving transistor when the driving transistor is diode-connected, transmits the control voltage and the data voltage to the control terminal of the driving transistor, a period in which the compensation signal is in an on-voltage state is longer than a period in which the scanning signal is in an on-voltage state, and is longer than about one horizontal period, and wherein the light emitting driver generates the compensations signal transferred to the second compensation signal line by inverting the light emitting signal transferred to the first light emitting signal line.

2. The display device of claim 1, wherein the control voltage depends on a threshold voltage of the light-emitting element.

3. The display device of claim 1, wherein the storage capacitor includes a first terminal and a second terminal, the first terminal of the storage capacitor is connected to the control terminal of the driving transistor, and each of the plurality of pixels further comprises a fourth switching transistor which connects the second terminal of the storage capacitor to a reference voltage in response to an on-voltage state of the compensation signal.

4. The display device of claim 3, wherein the compensation signal is in an on-voltage state before the scanning signal is in an on-voltage state, the light emitting signal comprises an off-voltage for a predetermined period of a period in which the compensation signal is in an on-voltage state, and the predetermined period is longer than a period in which the scanning signal is in the on-voltage state.

5. The display device of claim 1, wherein each of the plurality of pixels further comprises an auxiliary capacitor connected to the storage capacitor.

6. A display device comprising:

a scanning line which transfers a scanning signal;

a light emitting signal line which transfers a light emitting signal;

a compensation signal line which transfers a compensation signal;

a data line which transfers a data voltage;

a light-emitting element;

a storage capacitor which comprises a first terminal and a second terminal;

a first switching transistor which operates in response to the scanning signal and is connected between the data line and the first terminal of the storage capacitor;

a driving transistor comprising a first terminal, a second terminal connected to the light-emitting element, and a control terminal connected to the second terminal of the storage capacitor;

a second switching transistor which operates in response to the compensation signal and is connected between the first terminal and the control terminal of the driving transistor;

a third switching transistor which operates in response to the light emitting signal and is connected between a driving voltage and the first terminal of the driving transistor; and a light emitting driver which sequentially generates a plurality of light emitting outputs, which generates the light emitting signal with a first light emitting output of the plurality of light emitting outputs, and which generates the compensation signal by inverting a second light emitting output generates before the first light emitting output, wherein a first period in which the second switching transistor is turned on in response to the compensation signal is longer than a second period in which the first switching transistor is turned on in response to the scanning signal, and wherein the first period is longer than about one horizontal period.

7. The display device of claim 6, wherein the third switching transistor is turned off in response to the light emitting signal for a predetermined period of the first period, and the predetermined period is longer than the second period.

8. The display device of claim 6, further comprising a fourth switching transistor which operates in response to the compensation signal and is connected between a reference voltage and the first terminal of the storage capacitor.

* * * * *